United States Patent [19]

Olszowka

[11] Patent Number: 4,973,093

[45] Date of Patent: Nov. 27, 1990

[54] DOOR JAMMER

[76] Inventor: C. J. Olszowka, 44 Patterson Ave., Brantford, Ontario, Canada, N3S 6X2

[21] Appl. No.: 378,242

[22] Filed: Jul. 11, 1989

[30] Foreign Application Priority Data

Nov. 18, 1988 [CA] Canada ..... 583447-3

[51] Int. Cl.[5] ..... E05C 17/16

[52] U.S. Cl. ..... 292/339; 292/289

[58] Field of Search ..... 292/DIG. 15, 338, 337, 292/289; 70/94; 135/77, 78, 79, 80, 81

[56] References Cited

U.S. PATENT DOCUMENTS

| | | | |
|---|---|---|---|
| 598,405 | 2/1898 | Williams | 292/339 |
| 786,755 | 4/1905 | Grey | 292/339 |
| 2,116,941 | 5/1938 | Francis | 135/78 |
| 2,217,996 | 10/1940 | Sasgen | 292/338 |
| 2,277,939 | 3/1942 | Thalhammer | 292/338 |
| 2,480,382 | 8/1949 | Pagliuso | 135/81 X |
| 2,739,005 | 3/1956 | Naffziger . | |
| 2,870,281 | 1/1959 | Mitchell | 292/339 |
| 3,376,880 | 4/1968 | Stark | 135/81 |
| 3,901,258 | 8/1973 | Montgomery | 135/81 X |
| 4,036,518 | 2/1977 | Jost | 292/339 |
| 4,300,796 | 11/1981 | Lane . | |
| 4,411,284 | 10/1983 | Opitz | 135/81 |
| 4,456,291 | 7/1984 | Brogie | 292/DIG. 15 |

FOREIGN PATENT DOCUMENTS

| | | | |
|---|---|---|---|
| 376917 | 10/1938 | Canada . | |
| 1019016 | 10/1977 | Canada | 292/339 |
| 378937 | 8/1923 | Fed. Rep. of Germany | 135/78 |
| 2125282 | 3/1984 | United Kingdom | 135/81 |

*Primary Examiner*—Eric K. Nicholson

*Attorney, Agent, or Firm*—Robert M. Phipps

[57] ABSTRACT

A device for securing a closed inward swinging door from the interior, consisting of a vertical shaft of which one end is secured near the door handle and the opposite end has a pad which rests on the floor. Embedded into or located in this pad may be a one or more spikes or protrusions which upon an attempt to open the inward-swinging door from the exterior push down into the floor thus prohibiting its opening.

3 Claims, 3 Drawing Sheets

DOOR JAMMER

SECURITY DEVICE

This invention relates to manually operated security device which secures a closed inward swinging door from the inside.

Known devices and methods used for securing doors are varied and include door locks and chains. These are unsatisfactory in that they are not foolproof. Locks can be picked and force can render the latter ineffective. They are, moreover, unsatisfactory for their usefulness is only as good as the material to which and by which they are attached.

These known disadvantages may be overcome by the present invention comprising a barrier-type structure where one end contacts the door at the proximity of the door handle and the other end contacts the floor. For such a structure, any attempts to open the door result in a resistance which will not give way, even when force is increased. The object forms a wedge which is most effective in securing a door.

SUMMARY OF THE INVENTION

Broadly the present invention is related to a manually operated security device comprising a shaft with one end adapted to being secured to a closed inward-swinging door in the vicinity of the door handle and the other end has a pad which rests on the floor. One or more spikes or protrusions are located at the end which rests upon the floor and which push downward into the flooring when force or pressure is exerted to the door in an attempt to push it open.

In another embodiment the present invention relates to a manually operated security device for locking doors or the like comprising an elongated shaft body having a head portion and a foot portion, said head portion being adapted to be engaged with a closed inward swinging door in the vicinity of the door handle and said foot portion resting on the floor to keep said door in the closed position.

The head portion comprises a yoke adapted to engage the door handle underneath said handle.

In yet another embodiment of the present invention the head portion comprises a swinging hinged head adapted to be engaged underneath said door handle. The foot portion has a protector in contact with the floor to prevent slippage and marking of the floor, said protector is made of elastomeric material such as rubber or other suitable material.

In the following drawings which illustrate the embodiments of the invention:

Figure 1:
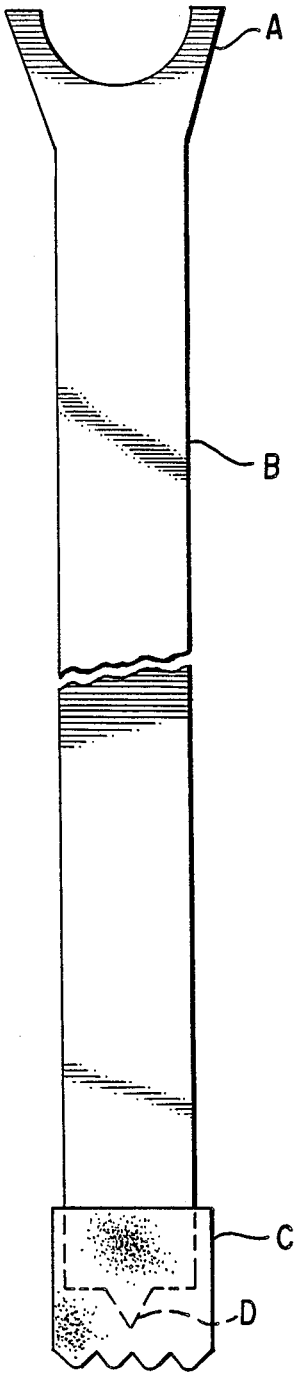
FIG. 1 illustrates the frontal profile of the invention.

Referring now to FIG. 1, the yoke or engaging head (A) at the top is used to go partially around/under the shank of a standard or usual door handle. The shank or shaft (B) is of such length so as to enable the angular fixation or wedging of the invention between the door handle and the floor thereby preventing any inward motion on any door with this invention in place. The composition or rubber (or similar material) protector (C) stops slippage and marking of the flooring. In operation should any excessive force be applied as in a forced entry, the sharp steel tip (D) would puncture the protector (C) and immediately bite into the flooring thus making it virtually impossible to push this product out of place.

Figure 2:
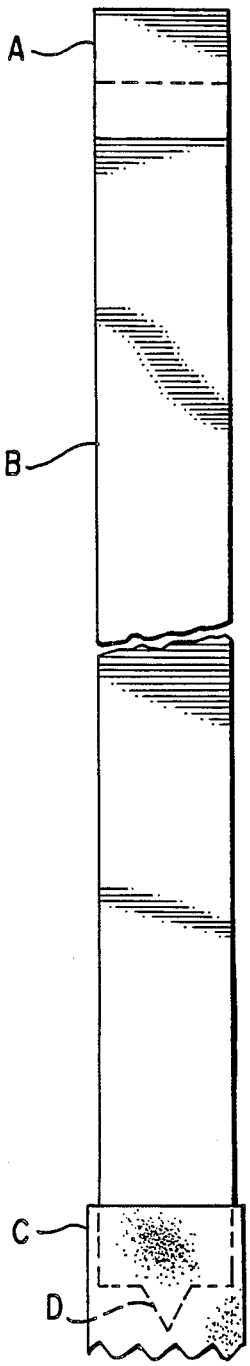
FIG. 2 illustrates the side profile of the invention.
Figure 3:
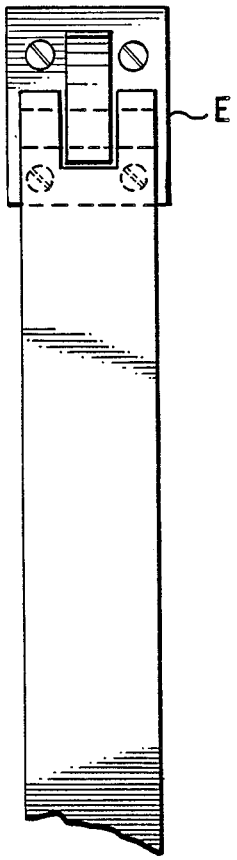
FIG. 3 illustrates a modified view of the frontal profile.

Referring now to FIGS. 2 and 3, instead of yoke (A) which makes for instant application or removal of the invention to/from a door, a hinged head (E) is used which will allow for the permanent installation of said invention with screws or bolts. This installation will be in the immediate vicinity of the door handle. The hinge permits the swinging of the invention upwards to a vertical position thus allowing for unobtrusive storage, with the swinging end retained by a retaining clip.

Figure 4:
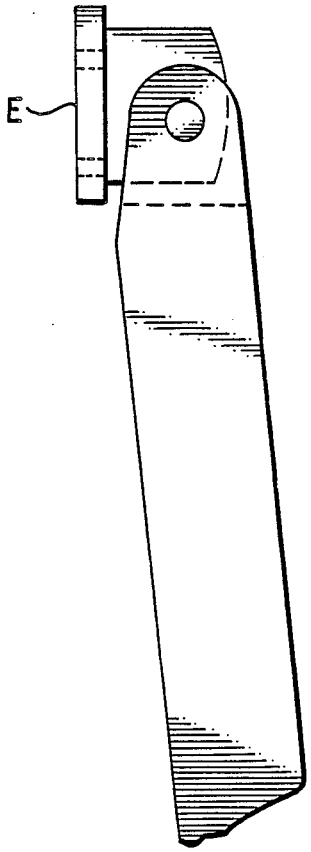
FIG. 4 is a side profile of FIG. 3.
Figure 5:
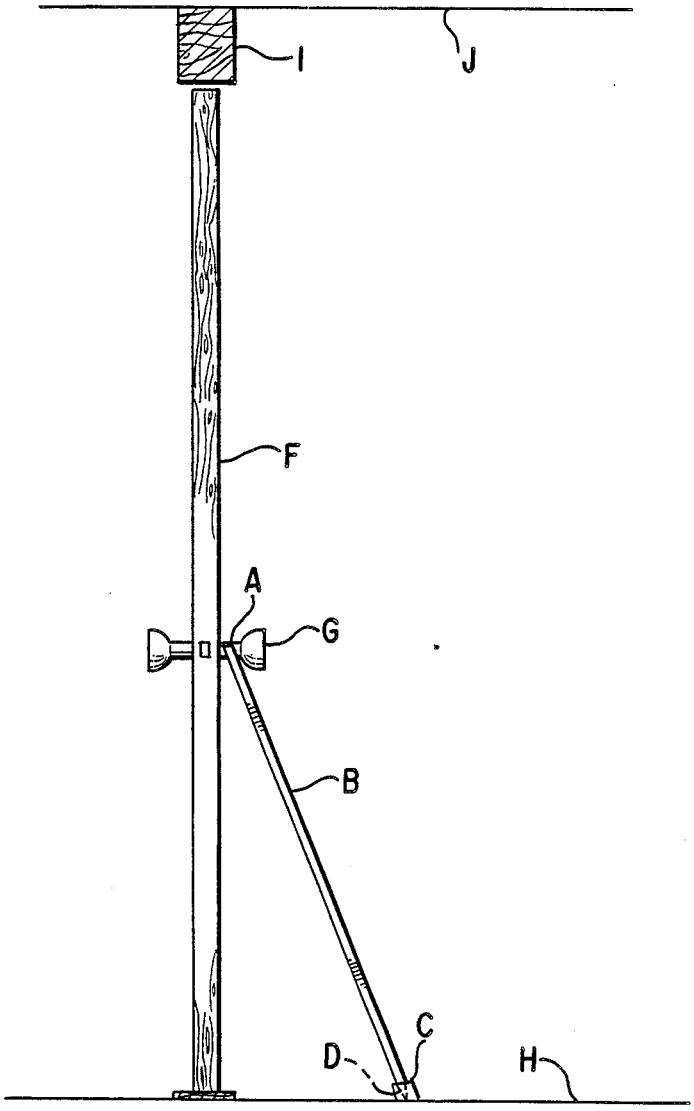
FIG. 5 illustrates the invention in place on a typical door.

Referring now to FIGS. 4 and 5, (F) designates the door, (G) the door knob or handle, (H) the floor, (I) the door header, (J) the ceiling, with (A-B-C-D) being the invention.

The embodiments of the invention in which an exclusive property or privilege is claimed are defined as follows:

1. A manually operated security device for locking doors or the like comprising an elongated shaft body having a head portion and a foot portion, said head portion being adapted to engage with a closed inward-swinging door adjacent a door handle and said foot portion having a protector in contact with the floor to prevent slippage and marking of the floor, wherein said protector is made of resilient elastomeric material and said foot portion further includes a spike or protrusion, said spike being adapted to be pushed progressively downwardly to puncture through the protector and into engagement with the floor as excessive force or pressure is exerted to the door in an attempt to open it, such foot portion being adapted to engage the floor to keep said door in the closed position.

2. A manually operated security device according to claim 1 wherein said head portion comprises a yoke adapted to engage the door handle underneath said handle.

3. A manually operated security device according to claim 1 wherein said head portion comprises a swinging hinged head adapted to be engaged underneath said door handle.

* * * * *